United States Patent [19]

Carlberg et al.

[11] Patent Number: 4,796,805

[45] Date of Patent: Jan. 10, 1989

[54] ICE MAKING METHOD USING ICE NUCLEATING MICROORGANISMS

[75] Inventors: Kristine E. Carlberg; Carole B. Lindsey, both of Rochester, N.Y.

[73] Assignee: Eastman Kodak Company, Rochester, N.Y.

[21] Appl. No.: 97,227

[22] Filed: Sep. 15, 1987

[51] Int. Cl.[4] ..... F25C 3/04

[52] U.S. Cl. ..... 239/2.2; 62/74

[58] Field of Search ..... 239/2.1, 2.2, 10, 14.2; 62/74, 347

[56] References Cited

U.S. PATENT DOCUMENTS

| | | | |
|---|---|---|---|
| 2,968,164 | 1/1961 | Hanson | 239/2.2 |
| 3,513,906 | 5/1970 | Richards | 239/2.2 |
| 4,200,228 | 4/1980 | Woerpel | 239/25 |
| 4,637,217 | 1/1987 | Owen | 62/74 |

OTHER PUBLICATIONS

Science News, vol. 126, No. 17, Oct. 27, 1984, p. 263 "Making Snow the Microbial Way".

*Primary Examiner*—Andres Kashnikow
*Assistant Examiner*—Michael J. Forman
*Attorney, Agent, or Firm*—J. Jeffrey Hawley

[57] ABSTRACT

The method comprises the steps of:

(a) forming an aqueous suspension of ice nucleating microorganisms;

(b) introducing the suspension into a water source to form an ice nucleated water source;

(c) distributing and freezing the ice nucleated water source.

The improvement is that the suspension of ice nucleating microorganisms is maintained throughout at a temperature below about 13° C.

5 Claims, No Drawings

ICE MAKING METHOD USING ICE NUCLEATING MICROORGANISMS

FIELD OF THE INVENTION

The present invention relates to the field of ice making. The invention is useful, for example in the making of snow, ice islands and in other large scale ice making processes.

DESCRIPTION RELATIVE TO THE PRIOR ART

In U.S. Pat. No. 4,200,228 there is disclosed a method for the making of snow whereby microorganisms are included in droplets that are sprayed into the air. The microorganisms that are used are of the type which are known to promote ice nucleation. As a result, snow can be made at temperatures that are much higher than are ordinarily possible. A typical microorganism that is useful in this method is a Pseudomonad and particularly *Pseudomonas syringae.*

In U.S. Pat. No. 4,637,217 there is disclosed a method for accelerating the freezing of sea water. Ice nucleating microorganisms are added to the water source, in this case sea water. The sea water is then distributed, such as by spraying, to make large ice structures. These ice structures are useful for oil drilling platforms in the polar regions. In this application of the ice nucleating microorganisms, the conditions of spraying are adjusted to promote the formation of ice on the surface rather than snow in the air. In addition to spraying, the patent also discloses other methods of distributing the ice nucleated sea water. For example, an area that is surrounded by a dam can be flooded by the nucleated sea water and allowed to freeze.

In these methods, the ice nucleating microorganism is introduced into the water supply prior to distribution of the water for freezing. In a typical snow making method for example, the water that is used is from an on site source such as a pond or stream. The water is pumped up the ski slope to the snow guns using large pumps. These pumps are inside enclosures in order to protect them from the weather and to facilitate maintenance.

The ice nucleating microorganism is usually delivered to the site in dried form. The microorganism is then resuspended in an aqueous medium, typically just water, in a concentrated form. This concentrate is mixed in a tank in the structure that contains the pumps for distributing the water to the ice making system. Since only a small amount of the microorganism is needed to nucleate the source water, only a small amount of this concentrate needs to be injected into the water supply. In a typical installation, a 100 liter suspension of microorganism having a microorganism concentration of 3 g/L will nucleate about 380,000 liters of water and will last for about 10 hours before the tank will need to be refilled with new suspension.

We found that the effectiveness of the ice nucleating microorganism was much greater for a fresh suspension than the suspension that was being used at the end of the 10 hour period. This meant that the amount of suspension that was needed to nucleate the source water increased over time even though the ice making conditions did not change. This increased usage of the microorganism suspension increases the cost. It is this problem that the present invention seeks to solve.

SUMMARY OF THE INVENTION

The present invention provides a method for making ice using ice nucleating microorganisms. The method comprises the steps of:

(a) forming an aqueous suspension of ice nucleating microorganisms;

(b) introducing the suspension into a water source to form an ice nucleated water source;

(c) distributing and freezing the ice nucleated water source.

The improvement is that the suspension of ice nucleating microorganisms is maintained throughout at a temperature below about 13° C.

In the prior art process, the ice nucleating suspension was made using cold source water. The tank is housed in the enclosure with the source water pumps and thus is very warm due to the heat generated by the equipment. Thus, while the outside temperature might be below freezing, the pump house temperature is typically between 20° and 30° C. Thus, even though the ice nucleating suspension is made with cold, e.g. 4° C., water, the temperature in the tank rapidly reaches the pump house temperature. At this temperature, we found that ice nucleating activity (INA) was rapidly lost.

If the temperature of the suspension is allowed to reach the pump house temperature, as much as about 70% of the INA is lost during the 10 hour holding period. In contrast, if the temperature of the suspension is kept at 13° C. or lower, we found that less than about 35% of the initial INA is lost.

DETAILED DESCRIPTION OF THE INVENTION

The present invention will be described with particular reference to the snow making embodiment. It will be understood however, that the invention is equally applicable to other ice making embodiments, such as making ice for load bearing ice structures described in the U.S. Pat. No. 4,637,217 mentioned above and for other uses.

Ice nucleating microorganisms that can be used in the method of the present invention are well known in the art. Any microorganism that has ice nucleation activity can be used in the method. Suitable microorganisms include Pseudomonads such as *P. syringae* and *P. fluorscens, P. coronafaciens* and *P. pisi.* Other microorganisms that are useful in the present invention include *Erwina herbicola.* The presently preferred microorganism is *P. syringae* ATCC No. 53543 deposited on Sept. 23, 1986 in accordance with the Budapest Treaty with the American Type Culture Collection in Rockville Md., USA.

Fermentation of the microorganism can be carried out using conventional fermentation techniques. Particularly preferred methods and media are described in copending, commonly assigned patent applications U.S. Ser. No. 910,600 filed Sept. 23, 1986; Ser. No. 944,120 filed Dec. 22, 1986; and Ser. No. 21,949 filed Mar. 6, 1987.

The ice nucleating microorganism is recovered in a dry form. The microorganism from the fermentation can be prepared in dried form in a number of ways. Spray drying and freeze drying are typical examples. Any drying process will reduce the INA to a certain extent. One preferred method that preserves a large amount of the INA that is produced in the fermentor is the process that is described in copending, commonly assigned U.S. patent application Ser. No. 910,552, filed Sept. 23, 1986 entitled "Recovery of Microorganisms Having Ice Nucleating Activity" of Lindsey. In this process, the medium is cooled, concentrated, run into a cryogenic liquid to form pellets and then the pellets are freeze dried at relatively low temperature.

At the time that the ice nucleating microorganisms are to be used, an aqueous suspension of the dried microorganism is prepared. In a typical preparation, 100 g of the dried microorganism is suspended in 100 L of water in a suitably sized tank. The tank can be equipped with a recirculation pump which is run for a period of time to insure that the microorganism is thoroughly suspended. About 15 minutes for the tank of the above illustration is sufficient. The concentration of the microorganism in the tank is not critical. Usually, the concentration is between about 1 and 15 g/L.

According to the present invention, the suspension in this tank is maintained at a temperature of 13° C. or less and preferably 10° C. or less. The suspension is kept at this temperature by a variety of conventional means such as recirculating the suspension through a heat exchanger or refrigerating the tank containing the suspension.

Where the suspension is made from the source water that is to be used to make the ice or snow, the water, as noted above, will typically be quite cold. In such a situation, we have found that the suspension can be maintained in the desired temperature range for long periods by simply insulating the tank containing the suspension. For the 100 L tank described above, closed cell foam insulation having a thickness of about 1.9 cm has been found to be sufficient where the ambient temperature is up to about 25° C.

From the tank holding the suspension, the suspension is injected into the water source that is used to make the ice. The suspension is metered into the source water in a conventional amount to form a nucleated water supply. Under typical snow making conditions, the suspension is metered at a rate such that the final concentration of nucleator in the source water is about 79 μg/L. The nucleated water is then distributed to the ski area by spraying with a snow gun using conventional methods.

In the example presented below, the INA is calculated using conventional techniques. The INA is determined by placing a plurality of microorganism containing water droplets (10 μl) on paraffin coated aluminum foil. The foil is maintained at −5° C. by placing it on a constant temperature bath. Details regarding this procedure are found in the literature, for example, Vali, Quantitative Evaluation of Experimental Results on the Heterogeneous Freezing of Supercooled Liquids, J. Atoms Sci., 28, 402–409 (1971). The INA data that was used for the examples is the INA that is found in the suspension after it has been made from the dried microorganism.

The following examples are submitted for a further understanding of the invention.

EXAMPLES 1–4

Several 6 g samples of dried *Pseudomonas syringae* were placed into several metal containers, each of which contained 2 liters of water. The starting temperature of the water was 6° C. The microorganisms were suspended by recirculating the contents of the containers using a Serfilco® pump. The resulting suspensions were placed in a variety of constant temperature locations. At various times, samples of the suspensions were tested for ice nucleating activity as described above and for temperature. (The temperature measured for the suspension was sometimes slightly higher than the nominal ambient temperature because of slight variations in the actual ambient temperature and the errors in temperature measurement.) The INA was compared to the INA of the starting suspension. The results are shown in Table I below. Examples 4 and 5 are comparative examples.

TABLE I

| | % INA Remaining and Suspension Temp. | | | | | | |
|---|---|---|---|---|---|---|---|
| Ex. | Ambient T °C. | 3.5 hrs | °C. | 24 hrs | °C. | 48 hrs | °C. |
| 1 | 5 | 93.3 | 5.5 | 58.9 | 5 | 52.5 | 5 |
| 2 | 10 | 75.9 | 11 | 47.9 | 10.5 | 33.9 | 10.5 |
| 3(c) | 15 | 58.9 | 13.5 | 12.3 | 16 | 0 | 16 |
| 4(c) | 21 | 44.7 | 18.5 | 0 | 23 | 0 | 21 |

The results show a significant improvement in the amount of INA that remains in the suspension if the temperature of the suspension is maintained according to the invention.

The invention has been described in detail with particular reference to preferred embodiments thereof, but it will be understood that variations and modifications can be effected within the spirit and scope of the invention.

What is claimed is:

1. In a method for making ice using ice nucleating microorganisms comprising the steps of:

(a) forming an aqueous suspension of ice nucleating microorganisms;

(b) introducing said suspension into a water source to form an ice nucleated water source;

(c) distributing and freezing said ice nucleated water source;

the improvement wherein said suspension of ice nucleating microorganisms is maintained throughout steps (a) and (b) at a temperature below about 13° C.

2. The method according to claim 1 wherein said suspension is maintained at a temperature below about 10° C.

3. The method according to claim 1 where said ice is in the form of snow and said distribution step comprises spraying said nucleated water source with a snow gun.

4. The method according to claim 1 wherein said microorganism is a Pseudomonad.

5. The method according to claim 4 wherein said microorganism is *P. syringae.*

* * * * *